US007101155B2

(12) United States Patent
Savidge et al.

(10) Patent No.: US 7,101,155 B2
(45) Date of Patent: Sep. 5, 2006

(54) VACUUM PUMPING SYSTEM AND METHOD OF CONTROLLING THE SAME

(75) Inventors: Derek Graeme Madgewick Savidge, West Sussex (GB); Neil Turner, Surrey (GB); Graeme Huntley, West Sussex (GB)

(73) Assignee: The BOC Group Plc, Windlesham (GB)

( * ) Notice: Subject to any disclaimer, the term of this patent is extended or adjusted under 35 U.S.C. 154(b) by 329 days.

(21) Appl. No.: 10/438,427

(22) Filed: May 15, 2003

(65) Prior Publication Data

US 2004/0126244 A1 Jul. 1, 2004

(30) Foreign Application Priority Data

May 31, 2002 (GB) ..... 0212757.9

(51) Int. Cl.
*F04B 49/22* (2006.01)
*C23C 14/00* (2006.01)
*E03B 5/00* (2006.01)

(52) U.S. Cl. ..... 417/53; 417/302; 118/50; 137/565.23

(58) Field of Classification Search ..... 417/53, 417/279, 302; 118/50, 715; 137/565.23
See application file for complete search history.

(56) References Cited

U.S. PATENT DOCUMENTS 5,088,895 A * 2/1992 Webb ..... 417/53
5,228,838 A * 7/1993 Gebele et al. ..... 417/53
5,788,825 A 8/1998 Park et al.
6,149,729 A 11/2000 Iwata et al.
6,446,651 B1 * 9/2002 Abbel ..... 137/1

FOREIGN PATENT DOCUMENTS

| | | |
|---|---|---|
| EP | 0343914 | 5/1989 |
| EP | 0510656 | 4/1992 |
| JP | 57161065 | 10/1982 |
| JP | 2001102281 A2 | 4/2001 |

* cited by examiner

*Primary Examiner*—Charles G. Freay
(74) *Attorney, Agent, or Firm*—Tarolli, Sundheim, Covell & Tummino LLP

(57) ABSTRACT

A vacuum pump system (10; 36; 46) for pumping gas from an enclosure (12) comprises: a vacuum pump unit (14) having a pump inlet (16) connectable with an outlet (18) of such an enclosure and a pump outlet (20) for exhausting gas; and a chamber (22; 50) selectively connectable with the pump inlet and the pump outlet, such that, in use, in a first state gas can be pumped from the chamber to the pump inlet by the vacuum pump unit and in a second state gas can be evacuated from the pump outlet to the chamber to reduce pressure at the pump outlet.

A method of controlling the vacuum pump system (10; 36; 46) comprises a first step of pumping gas from the chamber to the pump inlet using the vacuum pump unit and a second step of allowing gas to be evacuated from the pump outlet to the chamber to reduce pressure at the pump outlet.

17 Claims, 2 Drawing Sheets

VACUUM PUMPING SYSTEM AND METHOD OF CONTROLLING THE SAME

BACKGROUND OF THE INVENTION

1. Field of the Invention

The present invention relates to a vacuum pump system for pumping gas from an enclosure and to a method of controlling the system.

2. Background of the Related Art

A vacuum pump system may be used for pumping gas from an enclosure, such as a load lock chamber or transfer chamber of a semiconductor processing assembly. The system may comprise a vacuum pump unit having a pump inlet connectable with an outlet of such an enclosure and a pump outlet for exhausting gas, usually to atmosphere.

Processing of semiconductor wafers, for instance, takes place at low pressures close to vacuum which for brevity hereinafter will be referred to as vacuum. Transferral of wafers at atmospheric pressure to processing chambers at vacuum is achieved by the use of an intermediate chamber, or load lock chamber, which is adjustable between atmosphere and vacuum. Unprocessed semiconductor wafers are deposited in a load lock chamber and processed wafers are removed therefrom when the chamber is at atmospheric pressure. Wafers can be transferred between the load lock chamber and the processing chambers when the load lock chamber has been evacuated to vacuum.

It is desirable to be able to reduce the load lock chamber from atmosphere to vacuum quickly to increase efficiency of the semiconductor processing assembly. When the load lock chamber has been evacuated to vacuum, there is little or no mass flow rate through the vacuum pump unit—the unit is maintaining inlet and outlet pressure, or is holding back outlet pressure downstream thereof. When the vacuum pump unit is operating under this condition, it is said to be operating at 'ultimate'.

It is desirable to reduce the power requirement of a vacuum pump unit operating at ultimate. The work done by the vacuum pump unit is proportional to the change in inlet pressure to outlet pressure. Hence, if the inlet pressure is to be maintained at vacuum, the outlet pressure can be reduced to decrease the power requirement of the unit. Further, a vacuum pump system consumes less power if there is less gas in the system.

In a known arrangement, an inlet of a secondary pump unit is connectable to the pump outlet of the vacuum pump unit when operating at ultimate for reducing pressure at the pump outlet, which in turn, reduces the power requirement of the vacuum pump unit. This arrangement is undesirable from a number of standpoints. There is an additional power requirement of the secondary pump and also the necessity of maintenance thereof. Furthermore, there is the problem of accommodating the additional foot print of the secondary pump.

SUMMARY OF THE INVENTION

It is an object of the present invention to provide an improved solution to reducing power requirement of a vacuum pump unit.

The present invention provides a vacuum pump system for pumping gas from an enclosure, the system comprising: a vacuum pump unit having a pump inlet connectable with an outlet of such an enclosure and a pump outlet for exhausting gas; and a chamber selectively connectable with the pump inlet and the pump outlet, such that, in use, in a first state gas can be pumped from the chamber to the pump inlet by the vacuum pump unit and in a second state gas can be evacuated from the pump outlet to the chamber to reduce pressure at the pump outlet.

The present invention also provides a method of controlling a vacuum pump system for pumping gas from an enclosure, said system comprising: a vacuum pump unit having a pump inlet connectable with an outlet of such an enclosure and a pump outlet for exhausting gas; and a chamber selectively connectable with the pump inlet and the pump outlet, the method comprising a first step of pumping gas from the chamber to the pump inlet using the vacuum pump unit and a second step of allowing gas to be evacuated from the pump outlet to the chamber to reduce pressure at the pump outlet.

Other aspects of the invention are defined in the accompanying claims.

DESCRIPTION OF THE DRAWINGS

In order that the present invention may be well understood, three embodiments thereof, which are given by way of example only, will now be described with reference to the accompanying drawings, in which.

DETAILED DESCRIPTION OF SPECIFIC EMBODIMENTS

Figure 1:
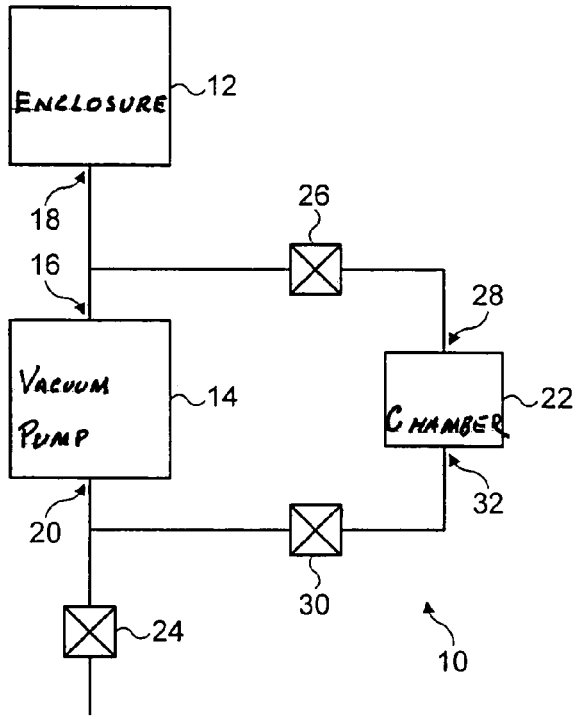
FIG. 1 shows schematically a first vacuum pump system.

Referring to FIG. 1, a vacuum pump system 10 is shown for pumping gas from an enclosure 12, the system comprising: a vacuum pump unit 14 having a pump inlet 16 connectable with an outlet 18 of such an enclosure and a pump outlet 20 for exhausting gas; and a chamber 22 selectively connectable with the pump inlet and the pump outlet, such that, in use, in a first state gas can be pumped from the chamber 22 to the pump inlet 16 by the vacuum pump unit 14 and in a second state gas can be evacuated from the pump outlet 20 to the chamber to reduce pressure at the pump outlet 20.

The volume of the chamber 22 is selected to reduce pump outlet 20 pressure (and gas within the system) by a predetermined amount, thereby to reduce by a predetermined amount the power requirement of the system, when operating at ultimate.

An exhaust valve means 24 which is preferably a non-return valve is provided downstream of the exhaust, or pump outlet, 20 for allowing gas flow from the pump outlet to atmosphere but for preventing gas flow in an opposite direction. A first valve means 26 is provided between an inlet 28 of chamber 22, and the pump inlet 16 and the enclosure outlet 18. When open, valve means 26 allows gas flow in both directions. A second valve means 30 is provided between an outlet 32 of chamber 22 and the pump outlet 20. When open, valve means 30 allows gas flow in both directions.

In use, gas is pumped by vacuum pump unit 14 from enclosure 12 and exhausted to atmosphere through valve means 24 until pressure in the enclosure is reduced to vacuum. In a first state of the system a first method step is performed. This occurs either before during or after evacuation of the enclosure. Valve means 26 is opened so that gas is pumped from chamber 22 to the pump inlet 16 by the vacuum pump unit and expelled from the system via exhaust valve 24. When chamber 22 is evacuated to a predetermined pressure, valve means 26 is closed to retain the reduced pressure in the chamber.

In a second state of the system, a second method step is performed. When the vacuum pump unit is operating at ultimate, and it is desired to reduce the power requirement of the unit, valve means 30 is opened, to allow gas to be evacuated from the pump outlet 20 to the chamber to reduce pressure at the pump outlet. Valve means 30 may then be closed. After this procedure, the vacuum pump unit is able to operate with reduced pressure differential between the pump inlet 16 and the pump outlet 20 thereby reducing the power requirement of the vacuum pump unit. It will be appreciated that the amount of gas within the system is also reduced.

The vacuum pump unit 14 is capable of evacuating a given volume per unit of time. Therefore, depending on the characteristics of the enclosure, chamber etc., it may not be desirable to evacuate the chamber 22 at the same time as the enclosure 12 is being evacuated. However, during an initial stage, evacuation of the enclosure may take place slowly to reduce disturbance in the enclosure caused by rapid changes in pressure. During this so-called soft start, any spare capacity of the vacuum pump unit may be utilised to evacuate chamber 22 to increase efficiency of the vacuum pumping system 10.

Figure 2:
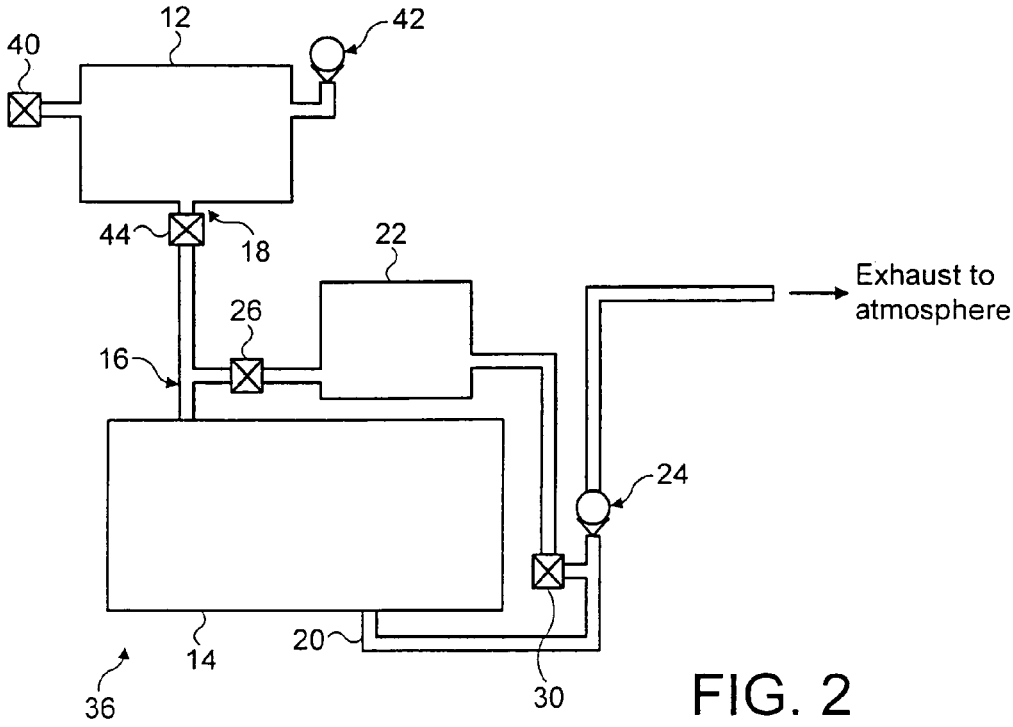
FIG. 2 shows schematically a second vacuum pump system.

A second embodiment is shown in FIG. 2, the arrangement of which is similar to that shown in FIG. 1 and like features will be given like reference numerals. An enclosure vent valve 40 is shown which, when opened, allows the pressure in enclosure 12 to increase to atmosphere. In this embodiment, enclosure 12 is a load lock chamber for a semiconductor processing assembly. A blow off valve 42 is also provided. An additional valve 44 is provided between the load lock chamber 12 and the vacuum pump unit 14 for isolating the load lock chamber from the vacuum pump unit.

The steps for controlling the vacuum pump system will now be described. When operating at ultimate, valves 26, 30, 40, 44 are closed and the vacuum pump unit is operating at reduced power requirement. At this time, pressure in the load lock chamber 12 is at vacuum. When semiconductor wafers have been processed and are to be removed and unprocessed wafers introduced, the load lock chamber is vented to atmosphere by opening valve 40. Once wafers have been removed from and deposited in the load lock chamber, valve 40 is closed and valve 44 is opened so that the load lock chamber can be evacuated to vacuum by vacuum pump unit 14. During such evacuation, the system is placed in a first state in which valve 26 is opened to allow simultaneous evacuation of chamber 22. Valves 40 and 44 are closed when the chamber 22 and load lock chamber 12 have reached their required respective pressures. When the vacuum pump unit is operating at ultimate, there is a delay between closing valve 26 and opening valve 30 to reduce the risk of the pump inlet and the pump outlet being connected. During a second state, valve 30 is opened for a sufficient time to allow the pump outlet to be reduced in pressure. The vacuum pump unit comprises a gear box which is provided with oil seals to prevent contamination. During evacuation of the pump outlet, sufficient time should be allowed for gas to seep through the oil seals. Once the pump outlet is reduced in pressure, all valves 26, 30, 40, 44 are closed and the vacuum pump unit operates at ultimate.

Chamber 22 can be positioned and constituted as appropriate. For instance, the chamber can be positioned inside or outside of a casing enclosing the vacuum pump system. The chamber may be incorporated with an existing part of the system, for instance, in the form of an annular chamber about a foreline duct, or pipe. In this latter arrangement, the annular chamber is constituted by a double skin round the pipe, the inner skin forming a portion of the foreline whilst the volume between the inner and outer skins forms the chamber 22. Other suitable arrangements can be adopted.

Figure 3:
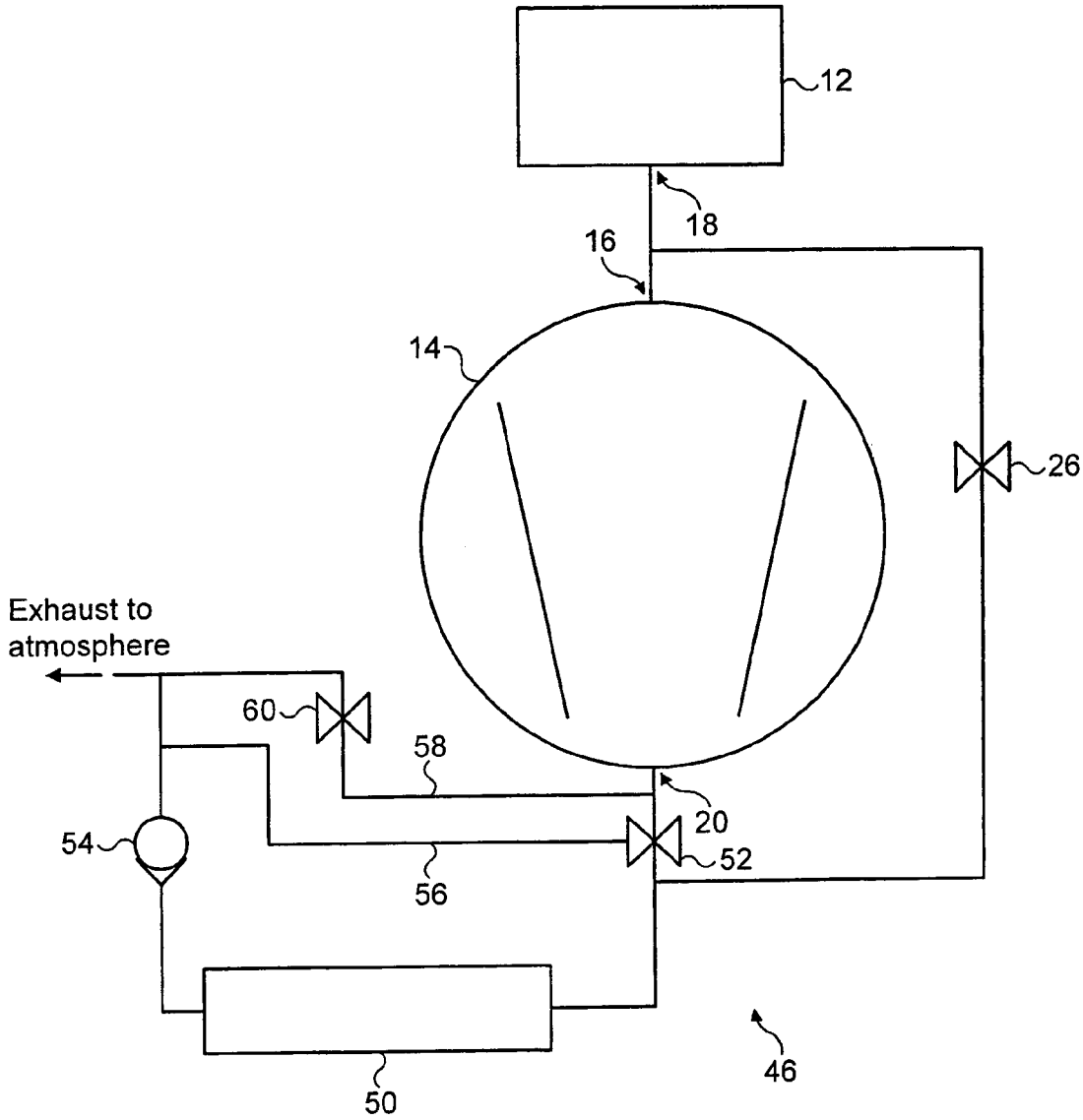
FIG. 3 shows schematically a third vacuum pump system.

FIG. 3 shows a third embodiment which differs from the previous embodiments in that the pressure chamber used for reducing pressure at the pump outlet is a chamber having a further use in the vacuum pump system. This means that little or no further space is required for incorporating the pressure chamber into the system. In the FIG. 3 embodiment, the chamber in question has a further, or primary, use as an exhaust silencer chamber 50 but alternatively an other chamber could be adopted.

In FIG. 3, like features are referenced with the same reference numerals as in the previous embodiments.

In the third embodiment, the pump outlet exhausts through valve 52, exhaust silencer 50 and valve 54 when the vacuum pump unit 14 is evacuating an enclosure 12 to vacuum. Valve 54 is preferably a non-return valve for allowing gas flow from the exhaust silence chamber to atmosphere but restricting gas flow in an opposite direction.

The vacuum pump unit 14 exhausts to atmosphere through duct 56, or through duct 58 in a modification of the system, when the exhaust silencer chamber is being evacuated in a first state of the system, as described in more detail below.

In use, in the first state valve 26 is opened when the exhaust silencer chamber 50 is to be evacuated so that gas is pumped from the chamber 50 to the pump inlet 16 by the vacuum pump unit 14. Valve 54 restricts gas from atmosphere entering chamber 50 when its pressure is reduced. If valve 52 is a three port valve, gas flowing out of the pump outlet 20 in the first state (i.e. when chamber 50 is being evacuated) is exhausted to atmosphere through duct 56 which gas flow is restricted by control of the three port valve when gas is being exhausted from the enclosure. If valve 52 is a two port valve, gas from chamber 50 is exhausted through duct 58 which comprises a further valve 60. Valve 60 is opened during the first state of the system to allow gas flow and closed when enclosure 12 is being evacuated to divert gas flow through silencer chamber 50 and non-return valve 54.

It will be appreciated that in the third embodiment, the exhaust valve and the second valve are constituted by a single valve 52.

The invention claimed is:

1. A method of controlling a vacuum pump system for pumping gas from an enclosure, said system comprising: a vacuum pump unit having a pump inlet connectable with an outlet of such an enclosure and a pump outlet for exhausting gas; and a chamber selectively connectable with the pump inlet and the pump outlet, the method comprising a first step of pumping gas from the chamber to the pump inlet using the vacuum pump unit and a second step of allowing gas to be evacuated from the pump outlet to the chamber to reduce pressure at the pump outlet.

2. A method as claimed in claim 1, wherein the system comprises a first valve means which is opened during said first method step and a second valve means which is opened during said second method step.

3. A method as claimed in claim 2, wherein during said first method step gas is pumped from the chamber by said vacuum pump unit and exhausted through an exhaust valve means and during said second step, said exhaust valve means prevents gas flow from downstream thereof from entering said chamber to allow gas at said pump outlet to be evacuated to the chamber.

4. A method as claimed in claim 3, wherein said first method step is effected during an initial evacuation stage of said enclosure.

5. A vacuum pump system for pumping gas from an enclosure, the system comprising: a vacuum pump unit having a pump inlet connectable with an outlet of such an enclosure and a pump outlet for exhausting gas; a chamber selectively connectable with the pump inlet and the pump outlet, such that, in use, in a first state gas can be pumped from the chamber to the pump inlet by the vacuum pump unit and in a second state gas can be evacuated from the pump outlet to the chamber to reduce pressure at the pump outlet, and wherein said vacuum pump unit exhausts through an exhaust valve means for preventing gas flow therethrough during use in said second state.

6. A system as claimed in claim 5, wherein the exhaust valve means is constituted by a single valve through which gas can be conducted in only one direction.

7. A system as claimed in claim 5, wherein the chamber has a first use to reduce pressure at the pump outlet and a further use in the vacuum pump system.

8. A system as claimed in claim 7, wherein the further use is as an exhaust silencer.

9. A system as claimed in claim 5, wherein chamber is annular and formed about a portion of a duct of the system.

10. A system as claimed in claim 5, wherein the volume of said chamber is selected to reduce pump outlet pressure by a predetermined amount thereby to reduce by a predetermined amount power requirement of the system when operating at ultimate.

11. A system as claimed in claim 5, wherein the chamber is selectively connectable with the pump inlet and the pump outlet by first valve means and second valve means, respectively, and during use in said first state said first valve means is opened and during use in said second state said second valve means is opened.

12. A vacuum pump system for pumping gas from an enclosure, the system comprising: a vacuum pump unit having a pump inlet connectable with an outlet of such an enclosure and a pump outlet for exhausting gas; and a chamber selectively connectable with the pump inlet and the pump outlet, such that, in use, in a first state gas can be pumped from the chamber to the pump inlet by the vacuum pump unit and in a second state gas can be evacuated from the pump outlet to the chamber to reduce pressure at the pump outlet, and wherein the volume of said chamber is selected to reduce pump outlet pressure by a predetermined amount thereby to reduce by a predetermined amount a power requirement of the system when operating at ultimate.

13. A system as claimed in claim 12, wherein the chamber is selectively connectable with the pump inlet and the pump outlet by first valve means and second valve means, respectively, and during use in said first state said first valve means is opened and during use in said second state said second valve means is opened.

14. A system as claimed in claim 12, wherein said vacuum pump unit exhausts through an exhaust valve means for preventing gas flow therethrough during use in said second state.

15. A system as claimed in claim 12, wherein the chamber has a first use to reduce pressure at the pump outlet and a further use in the vacuum pump system.

16. A system as claimed in claim 15, wherein the further use is as an exhaust silencer.

17. A system as claimed in claim 12, wherein chamber is annular and formed about a portion of a duct of the system.

* * * * *